US006829287B2

(12) United States Patent
Baumann et al.

(10) Patent No.: US 6,829,287 B2
(45) Date of Patent: Dec. 7, 2004

(54) ELECTRODE CONNECTION WITH COATED CONTACT SURFACES

(75) Inventors: Stefan Baumann, Augsburg (DE); Norbert Richter, Augsburg (DE); Georg Burkhart, Diedorf (DE)

(73) Assignee: SGL Carbon AG, Meitingen (DE)

( * ) Notice: Subject to any disclaimer, the term of this patent is extended or adjusted under 35 U.S.C. 154(b) by 0 days.

(21) Appl. No.: 10/714,984

(22) Filed: Nov. 17, 2003

(65) Prior Publication Data

US 2004/0097145 A1 May 20, 2004

(30) Foreign Application Priority Data

Nov. 15, 2002 (DE) ..... 102 53 254

(51) Int. Cl.[7] ..... H05B 7/14

(52) U.S. Cl. ..... 373/92; 439/87

(58) Field of Search ..... 373/88–93; 439/87, 439/427, 429, 784, 889, 894; 403/DIG. 5, 298, 299, 320

(56) References Cited

U.S. PATENT DOCUMENTS

| | | | | |
|---|---|---|---|---|
| 3,814,828 A | * | 6/1974 | Gazda | 373/92 |
| 4,629,280 A | * | 12/1986 | Semmler et al. | 373/92 |
| 5,407,290 A | * | 4/1995 | Tahon et al. | 403/298 |
| 6,500,022 B2 | * | 12/2002 | Varela | 439/429 |

FOREIGN PATENT DOCUMENTS

| | | |
|---|---|---|
| CH | 487 570 | 4/1970 |
| DE | 23 30 798 | 8/1974 |
| DE | 37 41 510 A1 | 7/1988 |
| GB | 1155521 | 6/1969 |
| GB | 1457618 | 12/1976 |

* cited by examiner

*Primary Examiner*—Tu Ba Hoang
(74) *Attorney, Agent, or Firm*—Laurence A. Greenberg; Werner H. Stemer; Ralph E. Locher

(57) ABSTRACT

An electrode connection includes coated contact surfaces in differently constructed electrode strings formed of carbon and graphite being provided with sliding layers. With the aid of these sliding layers, the elements of a string can be screwed more firmly against one another, with the result that a higher release torque and higher operating reliability are achieved.

15 Claims, 3 Drawing Sheets

ELECTRODE CONNECTION WITH COATED CONTACT SURFACES

BACKGROUND OF THE INVENTION

Field of the Invention

The invention relates to an electrode connection including electrodes having end-side boxes with internal threads and nipples each connecting two electrodes, as well as to electrodes having a box located on one end side with an internal thread and an integrated nipple located on the other end side, and an electrode and nipple jointly constructed as a preset. The electrode connection is provided for an electrode string, operating at temperatures of substantially above 300° C., for use in an electric arc furnace for the production of high-melting metals.

The production of carbonized or graphitized carbon bodies is a technique which has been mastered for more than 100 years and is employed on an industrial scale and is therefore refined in many respects and optimized in terms of cost. One of the descriptions of that technique is found in ULLMANN'S ENCYCLOPEDIA OF INDUSTRIAL CHEMISTRY, Vol. A5, VCH Verlagsgesellschaft mbH, Weinheim, Germany 1986, p. 103 to 113.

The applicability of electrodes, nipples and electrode strings in an electric arc furnace depends on the properties achieved during production, in particular surface properties. Those surface properties depend, for example, on the type of material (degree of graphitization), on the pore content, on the grain size, on the type of machining which determines the surface roughness, but also on the surrounding conditions. Electrodes are stored and handled in a steel mill and in that case are exposed to contamination caused, for example, by steel mill dust. The above-mentioned factors determine the coefficients of friction which play a part in the assembly of two bodies, for example an electrode and a nipple or two electrodes, and in the sliding of two surfaces on one another.

An electric arc furnace contains at least one electrode string. That string is held at the upper end of a carrying arm, through which the electrical current also passes into the electrode string. When the furnace is in operation, the arc passes from the lower tip of the string into the melt batch located in the furnace. The electrode string slowly burns away at its lower end due to the arc and to the high temperatures in the furnace. The shortening of the electrode string is compensated for in that the string is advanced piece by piece into the furnace and, if required, an additional electrode is screwed on at the upper end of the string. If required, a string which is partially burnt away is also extracted as a unit from the carrying arm and replaced by a fresh string of sufficient length.

The screwing of individual electrodes onto a string located in the furnace or the screwing together of electrodes to form a fresh string takes place by hand or through the use of a mechanical device. Particularly with regard to electrodes having a large diameter of 600 mm or above, considerable forces and torques have to be applied or screwing work performed in order to ensure that an electrode string is held together. It is critically important for the functioning of an electric arc furnace that a string be held together.

The holding together of a string is put at risk during transport, but primarily when a furnace is in operation. During the operation of a furnace, considerable bending moments due to the pivoting of the furnace vessel, including the string, act repeatedly on the electrode string, or the electrode string is exposed to persistent vibration, and impacts on the string caused by the charging material are also detrimental to the holding together of the string. All types of load, that is repeated bending moments, vibrations and impacts, may cause a loosening of the screw connection of electrodes. Loosening can be considered to be the result of unavoidable and/or undesirable actions.

The term "release torque" is appropriate for characterizing the holding together of an electrode string through the use of a measurement variable. The release torque for screwing on an electrode connection is determined through the use of a measuring apparatus. Below the range of mechanical damage to the threads involved, the loosening of a screw connection becomes more improbable and operation with the electrode string becomes more reliable, the higher the release torque of an electrode connection becomes.

In order to provide an understanding, the consequences of a loosening of the screw connections of an electrode string during furnace operation may be outlined as follows:

In the event of loosening, it is to be assumed that the bracing of the screw connection is reduced. Consequently, the pressure forces of the contact surfaces of adjacent string elements also decrease. Loosening can progress to such an extent that some of the contact surfaces separate from one another.

Consequently, the electrical resistance in the connection rises. The surfaces which have remained in contact are loaded with an increased current density. The increased current density leads to local thermal overheating.

During the loosening of a screw connection, as a rule, the nipple is exposed to a high thermal and mechanical load. Finally, the mechanical failure of the nipple due to overheating and mechanical load is exhibited. As a result, the tip of the electrode string falls off and drops into the steel melt, the arc breaks off and the melting operation is terminated.

The terms used in the following text are to be understood as follows:

- The ends of an electrode are also designated by the term end side.
- An electrode has a cylindrical surface area and, on each of the two sides, an end surface disposed perpendicularly to the electrode axis.
- A box is a coaxially disposed depression in the end side of an electrode. Usually cylindrical or conical internal threads are incorporated into the coaxial inner walls of a box.
- A nipple is a cylindrical or double-conical screw with an end surface disposed perpendicularly to the nipple axis, on each of the two sides. For the purpose of connecting two electrodes, a nipple is screwed, approximately halfway in each case, into a box of adjacent electrodes.
- A preset is formed of an electrode and of a nipple screwed halfway into a box of the electrode.
- There are electrodes which have a box on only one end side and have an outward-pointing coaxial thread on the other end side. Such an outward-pointing coaxial thread is designated as an integrated nipple.
- It is not only an electrode and a nipple which have end surfaces, but rather the integrated nipple has an outer end surface disposed perpendicularly to the nipple axis as well.
- Particulars as to the viscosity of the sliding layer relate to the delivery state of the electrodes and nipples, not to the state of the sliding layer at the time of production of that layer.

In order to deal as effectively as possible with the problems of the insufficient holding together and insufficient current transition of part of an electrode string, widely differing considerations have been adopted and the practice outline below is applied.

Swedish Patent No. 43352, filed Dec. 12, 1917, describes sheet-metal strips which have been inserted into the thread flights of electrodes with integrated nipples. Since electrodes for the melting of high-melting metals become very hot precisely in the vicinity of the electric arc, it is therefore to be expected that the sheet metal in the thread flights will melt and the intended effect will be lost. In the present-day practice of electric arc furnaces, insertion of sheet-metal strips into the contact surfaces between two elements of an electrode string is not employed.

In an article by J. K. Lancaster entitled "Transitions in the Friction and Wear of Carbons and Graphites Sliding Against Themselves" from ASLE TRANSACTIONS, Vol. 18, 3, p. 187 to 201, frictional conditions between carbon bodies, preferably in the case of different frictional velocities, are investigated. That publication does not reveal any teaching as to how two carbon bodies can be screwed as firmly as possible against one another, apart from the general recognition that, at very low relative velocities of the two carbon bodies, low coefficients of friction are observed, as seen in FIGS. 1, 2 and 6. That recognition points, instead, to a slight sliding off of stationary carbon bodies from one another.

Swiss Patent No. 487 570, corresponding to UK Patent No. 1,155,521, describes a cement for securing a nipple connection between carbon electrodes. The cement is used in such a way that it is located in the thread flights between the nipple and the threaded box of the electrode and is carbonized there when an electrode string is in operation. A special composition of the cement is claimed. The screw connection of an electrode string is secured, in that case, by the production of solid bridges between the individual parts of the string. That principle differs entirely from the principle according to the present invention. According to the latter, the parts of the string are retained against one another through the use of higher pressure forces which, during screw connections, become possible due to an applied thin sliding layer on the contact surfaces.

German Published, Non-Prosecuted Patent Application DE 37 41 510 A1 describes a self-securing connection element, preferably a metallic screw. However, that publication also reports, in column 2, line 21 ff, on anti-unscrewing devices in screw connections in which adhesive and hardener are used in a microencapsulation. During assembly, the microcapsules burst open and release the adhesive and hardener. The hardened adhesive produces solid bridges between the parts to be secured. That principle differs entirely from the principle according to the present invention outlined in the previous paragraph.

German Patent DE 23 30 798 describes a graphite electrode which is provided on all sides with a protective covering. Since that covering is also applied to the end surfaces of the electrodes, it could have an effect on the reliability of the holding together of an electrode string, although that is not described. The covering contains aluminum alloys, as described in the second column, penultimate paragraph, and becomes viscoplastic between 600 and 800° C., as described in the second column, fifth paragraph. The composition of the covering gives rise, on one hand, to a favorable low specific electrical resistance and consequently to good current transition from one electrode portion to the next. On the other hand, in the temperature range of between 600 and 800° C., the viscoplastic state of the covering necessarily brings about a reduction in the pressure force between adjacent electrode portions, because the viscoplastic covering mass creeps away under the pressure force caused initially by the screw connection. That reduced pressure force is the opposite of that which is achieved through the use of the higher pressure force according to the present invention for securing the holding together of an electrode string.

In steel mill practice, attempts are made to screw the electrodes as firmly as possible to one another. As mentioned above, the forces, torques or screwing work capable of being applied by hand are limited. Those magnitudes can be increased considerably through the use of mechanical devices, but such mechanical screwing devices are employed only in some steel mills. Steel mill practice shows that loosenings in the electrode strings occur repeatedly.

SUMMARY OF THE INVENTION

It is accordingly an object of the invention to provide an electrode connection with coated contact surfaces, which overcomes the hereinafore-mentioned disadvantages of the heretofore-known devices of this general type and which prepares connection locations of an electrode string in such a way that no loosening of individual elements of the string from one another occurs so that high reliability of the holding together of a string is afforded. A further object of the invention is to lower transitional resistance from one element of the string to the next element. Another object of the invention is to increase measurable release torque between adjacent elements.

With the foregoing and other objects in view there is provided, in accordance with the invention, in an electrode string for use in an electric arc furnace for the production of high-melting metals, an electrode connection comprising electrode elements each having one or two end-side boxes with internal threads. At least one of the electrode elements may have one end-side box with internal threads and an integrated nipple element with external threads. At least one nipple element has external threads to be screwed into the internal threads for interconnecting two of the electrode elements. At least one of the electrode elements and a nipple element may jointly form a preset. Each of the elements has at least one contact surface to be placed in contact with at least one adjacent contact surface of another of the elements. A thin sliding layer is applied on the contact surfaces. The adjacent contact surfaces have a pressure force in a range of 0.1 to 80 $N/mm^2$.

A sliding layer of this type makes it possible to screw the screw connection together further than without a sliding layer, given the same force expended for screwing or the same torque applied.

The type, quantity and distribution of the sliding layer are defined and are applied according to the knowledge gained in screwing tests. This means that the individual customer for electrodes should not apply the sliding layer and this operation should take place at the electrode manufacturer's premises because of:

reproducibility, the use of a group of optimal measures, the application of quantity and of thickness, the selection of the contact surfaces with the best effect, and the transitional resistance favorably influenced thereby.

This preparation of the connection locations of an electrode string with a sliding layer ensures that, after intensive screwing, an electrode string does not exhibit any loosening of the individual elements of the string from one another or exhibits a high degree of reliability in the holding together of a string. The reliability of the holding together or the absence of loosening are defined with the aid of the release torque. As described in detail in the following examples, higher release torques are achieved through the use of the preparation of the connection locations according to the invention than with unprepared connection locations. This applies both to manually screwed strings and to electrode strings screwed together through the use of a mechanical device.

It was not obvious to apply a sliding medium to the contact surfaces of screw connections for carbon or graphite electrodes. The reason for this is the generally known fact that graphite itself is a lubricant. This is true at least in the presence of the least possible quantities of moisture. In this case, normal atmospheric moisture is already sufficient to achieve very low coefficients of friction.

A further argument against the use of sliding media in screw connections for carbon or graphite electrodes is the high porosity of carbon or graphite electrodes. Low-viscosity sliding media, such as, for example, oils, would immediately be sucked into the interior of the material by the contact surfaces due to the capillary action of the carbon or graphite and, at most, depending on the wetting angle between surface and sliding medium, a very thin and possibly easily removable film of such a sliding medium would remain on the contact surface.

In accordance with another feature of the invention, the sliding layer applied to the contact surfaces of the elements of an electrode string covers the surfaces partially or continuously in a closed manner. Partial covering is sufficient, in particular, in the case of thick sliding layers with a thickness of more than 0.5 mm. The material of the sliding layer lies on the contact surfaces and can therefore also be designated as film-forming, in contrast to low-viscosity materials, through the use of which it is less easily possible to form a sliding layer on the porous carbon elements. The kinematic viscosity of the material of the sliding layer is at least 20 $mm^2/s$. The material of the sliding layer belongs to the group of lubricants which also include solid lubricants and sliding lacquers. The group of lubricants is distinguished by a wide diversity which embraces various classes of chemicals, usually organic compounds. These usually organic compounds are mixed with one or more additives, depending on the requirements to be met by the lubricant, with the number of additives which are considered being very large.

The action of the lubricants varies. It was shown that, in the case of the screw connection of elements of an electrode string formed of carbons, specific combinations of pressure forces of the adjacent carbon elements and of lubricants are advantageous. In accordance with a further feature of the invention, at relatively low pressure forces of 0.1 to 5.0 $N/mm^2$, lubricants from the group of fluoropolymers, polytetrafluoroethylenes (PTFE), solid lubricants such as molybdenum disulfides and/or silicones, are suitable as materials of the sliding layer on the adjacent contact surfaces of the screw connection.

In accordance with an added feature of the invention, at relatively higher pressure forces of 1 to 80 $N/mm^2$, lubricants from the group of viscous lubricants with kinematic viscosities of between 20 and 1000 $mm^2/s$, preferably of between 100 and 600 $mm^2/s$, such as paraffins and/or esterified long-chain carboxylic acids, are suitable as materials of the sliding layer on the adjacent contact surfaces of the screw connection.

The further object of the invention is achieved in that the transitional resistance between adjacent elements, prevailing at temperatures of use in the electric arc furnace of substantially above 300° C. and in the case of adjacent elements braced through the use of defined tightening torques, is ten to thirty percent lower with the originally applied thin sliding layer than the transitional resistance between adjacent elements without the originally applied thin sliding layer.

A further object of the invention was to increase the measurable release torque between adjacent elements of an electrode string. The object is achieved in that, according to the invention, a sliding layer is applied to the contact surfaces of the elements of an electrode string. The elements thus treated are screwed against one another, so that the contact surfaces of adjacent elements are under a defined pressure force, depending on the degree of screwing. Reliability of the holding together of an electrode string at the screwing location is measured through the use of the release torque of the connection. It is found, in the case of measurements, that the release torque between adjacent elements, which is measurable at a defined pressure force of adjacent elements, is at least 15 percent higher with the thin sliding layer than the release torque between adjacent elements with the same pressure force without the thin sliding layer.

A further explanation may be gathered from example 3 below.

In accordance with an additional feature of the invention, the sliding layer is located on the contact surface of the elements of an electrode string and in this case, the contact surface is formed of one or more of the surfaces of the end surfaces of the electrode and of the threaded surfaces of the electrode box and/or of the threaded surfaces of the nipple.

In accordance with yet another feature of the invention, in contrast to low-viscosity sliding media which may be sucked up by the porous carbon and possibly not form a sliding layer, a sliding layer is formed on the porous carbon or graphite contact surface through the use of film-forming or else high-viscosity sliding media. The sliding layer on the contact surface expediently has a thickness of 0.001 to 5.0 mm, preferably of 0.005 to 0.5 mm.

In accordance with a concomitant feature of the invention, an electrode string may be formed of a unitary material or of different materials. The most frequent instance is that in which the electrode and the nipple are formed of graphite. In another instance, the electrode and the nipple are formed of carbonized carbon, both components having been treated, during their production, with a maximum temperature of well below 2000° C., preferably of below 1200° C. In yet another instance, the electrode is formed of carbonized carbon and the nipple of graphite.

A delivery form which is expedient for the electrode user, mostly an electric steel mill, is the preset. Either the inner contact surface of the preset is left free at the electrode manufacturer's premises and the electrode and nipple are screwed together or the electrode and/or the nipple have a thin sliding layer on the contact surface. In this case, the inner contact surface is formed of one or both of the surfaces of threaded surfaces of the electrode box and of threaded surfaces of the nipple.

When a preset is used in the electric arc furnace, according to the invention, the preset, too, has a thin sliding layer on one or more of the contact surfaces with the next preset or with the next part of the electrode string. In this case, on one end side, the preset has a contact surface which is formed of one or both of the surfaces of the end surface of the electrode and of threaded surfaces of the electrode box and, on the other end side, the preset has a contact surface which is formed of one or more of the surfaces of the end surface of the electrode, threaded surfaces of the nipple and end surface of the nipple.

Not all electrodes have on both end sides coaxially disposed boxes with internal threads. On the contrary, there are electrodes which have such a box on only one end side and on the other end side have an integrated coaxial nipple. Such electrodes, too, have the sliding layer according to the invention on the desired contact surface. In these cases, the desired contact surface is formed, on one end side of the electrode, of one or both of the surfaces of the end surface of the electrode and of threaded surfaces of the electrode box and, on the other end side of the electrode, of one or more of the surfaces of the end surface of the electrode and threaded surfaces of the integrated coaxial nipple.

EXAMPLE 1

In this example, on a screwing stand available from the company Piccardi (Dalmino(Bergamo)/Italy) having the designation "Nippling Station", constructed in the year 1997, two graphite electrodes with diameters of 750 mm in each case were screwed together with a suitable nipple to form an electrode string. In this case, a preset formed of an electrode and of a nipple already prescrewed into a box of the electrode was used. The preset and the electrode were screwed to one another. When a tightening torque of 7500 Nm was reached, screwing was terminated.

In order to characterize the reliability of the holding together of the screw connection, the connection was subsequently opened again and at the same time the release torque was measured.

This basic procedure was executed in three variants A, B and C:

Variant A

The contact surfaces of the preset and electrode did not receive any sliding layer according to the invention and were screwed together in their original state.

Variant B

The contact surfaces of the preset and of the individual electrode were provided with the sliding layer according to the invention. The sliding layer was formed of bearing grease having the type designation ARCANOL 12V from the company FAG Kugelfischer (Schweinfurt/Germany). The contact surfaces selected were the end surface of the electrode and the free threaded surfaces of the nipple. The thickness of the sliding layer was 0.1 mm.

Variant C

Only the end surface of the electrode of the preset was provided with the sliding layer according to the invention. The sliding layer was formed of bearing grease having the type designation ARCANOL 12V from the company FAG Kugelfischer (Schweinfurt/Germany). The thickness of the sliding layer was 0.5 mm.

TABLE 1

The values given apply to electrodes having a diameter of 750 mm and to a tightening torque of 7500 Nm during screwing.

| | Sliding medium | Coated surfaces | Layer thickness [mm] | Release torque [Nm] |
|---|---|---|---|---|
| Variant A | Without sliding medium | | | 8 300 |
| Variant B | Bearing grease ARCANOL 12 V | End surface of electrode and threaded surfaces of nipple | 0.1 | >20 000 |
| Variant C | Bearing grease ARCANOL 12 V | End surface of electrode | 0.5 | 15 500 |

As can be gathered from Table 1, the release torque was dependent on the type of treatment of the contact surfaces and the fraction of the coated surfaces on the entire contact surface. The lowest release torque was achieved in the case of contact surfaces without a sliding layer (variant A). After the application of a sliding layer to the contact surface, very high release torques were measured. When only part of the entire contact surface was provided with a sliding layer (variant C), the release torque was lower than in the case of a complete coating of the contact surface (variant B).

Greater thicknesses of the sliding layers than in variant C did not reduce the level of the release torque. The excess material of the sliding layer was pressed into the pores of the electrodes and the nipple or out of the entire connection of the electrode string. In those tests not listed in Table 1, it could be observed that greater thicknesses of the sliding layers led to increased values for screwing work, with these values likewise not being noted in Table 1.

EXAMPLE 2

In these tests, the basic procedure of Example 1 was selected again. In contrast to Example 1, however, both electrodes with a diameter of 750 mm and electrodes with a diameter of 600 mm were used. As in Example 1, the electrodes with a diameter of 750 mm were screwed together with a tightening torque of 7500 Nm. However, the electrodes with a diameter of 600 mm were screwed together with a tightening torque of 4000 Nm.

In the case of the test variants A and B, electrodes with a diameter of 750 mm were used and screwing was carried out with a tightening torque of 7500 Nm.

Variant A

The contact surfaces of the preset and the electrode did not receive a sliding layer according to the invention and were screwed together in their original state.

Variant B

The contact surfaces of the preset and the individual electrode were provided with the sliding layer according to the invention. The sliding layer was formed of an aqueous PTFE suspension having the type designation TF 5032 PTFE from the company Dyneon (Burgkirchen/Germany). The contact surfaces selected were the end surface of the electrode and the free threaded surfaces of the nipple. The thickness of the sliding layer was 0.005 mm.

In the case of the test variants C and D, electrodes with a diameter of 600 mm were used and screwing was carried out with a tightening torque of 4000 Nm.

Variant C

The contact surfaces of the preset and electrode did not receive a sliding layer according to the invention and were screwed together in their original state.

Variant D

The contact surfaces of the preset and of the individual electrode were provided with the sliding layer according to the invention. The sliding layer was formed of an aqueous PTFE suspension having the type designation TF 5032 PTFE from the company Dyneon (Burgkirchen/Germany). The contact surfaces selected were the end surface of the electrode and the free threaded surfaces of the nipple. The thickness of the sliding layer was 0.005 mm.

TABLE 2

The values given apply to the electrodes with a diameter of 750 mm and to a tightening torque of 7500 Nm during screwing.

| | Sliding medium | Coated surfaces | Layer thickness [mm] | Release torque [Nm] |
|---|---|---|---|---|
| Variant A | Without sliding medium | | | 8 300 |
| Variant B | Aqueous PTFE suspension | End surface of electrode and threaded surfaces of nipple | 0.005 | 11 500 |

TABLE 3

The values given apply to electrodes with a diameter of 600 mm and to a tightening torque of 4000 Nm during screwing.

| | Sliding medium | Coated surfaces | Layer thickness [mm] | Release torque [Nm] |
|---|---|---|---|---|
| Variant C | Without sliding medium | | | 4 100 |
| Variant D | Aqueous PTFE suspension | End surface of electrode and threaded surfaces of nipple | 0.005 | 5 200 |

As may be gathered from Tables 2 and 3, the release torque was dependent on the type of treatment of the contact surfaces. The lower release torque in each case was achieved in the case of contact surfaces without a sliding layer (variants A and C). The higher release torque was measured after the application of a sliding layer to the contact surface (variants B and D).

EXAMPLE 3

In this example, on a test stand from the company Piccardi (Dalmino(Bergamo)/Italy) having a designation "Nippling station", constructed in the year 1997, two graphite electrodes with diameters of 750 mm in each case were screwed together with a suitable nipple to form an electrode string. In this case, a preset formed of an electrode and of a nipple already prescrewed into a box of the electrode was used. The preset and electrode were screwed to one another. In contrast to Examples 1 and 2, in Example 3 screwing was not carried out up to an upper value of a tightening torque, but until a defined pressure force of the end surfaces of adjacent electrodes of a screw connection was reached. 8 MPa was selected as the pressure force.

In order to characterize the reliability of the holding together of the screw connection, the connection was subsequently opened again and at the same time the release torque was measured.

This basic procedure was executed in two variants A and B:

Variant A

The contact surfaces of the preset and the electrode did not receive any sliding layer according to the invention and were screwed together in their original state.

Variant B

The contact surfaces of the preset and of the individual electrode were provided with the sliding layer according to the invention. The sliding layer was formed of the bearing grease having the type designation ARCANOL 12V from the company FAG Kugelfischer (Schweinfurt/Germany). The contact surfaces selected were the end surface of the electrode and the free threaded surfaces of the nipple. The thickness of the sliding layer was 0.1 mm.

TABLE 4

The values given apply to electrodes with a diameter of 600 mm and to a pressure force of the end surfaces of adjacent electrodes of 8 MPa after screwing.

| | Sliding medium | Coated surfaces | Layer thickness [mm] | Release torque [Nm] |
|---|---|---|---|---|
| Variant A | Without sliding medium | | | 3 900 |
| Variant B | Bearing grease ARCANOL 12 V | End surface of electrode and threaded surfaces of nipple | 0.1 | 4 500 |

As may be gathered from Table 4, the release torque was dependent on the type of treatment of the contact surfaces. The lower release torque was achieved in variant A with contact surfaces without a sliding layer. After the application of a sliding layer to the contact surfaces and after the setting of a pressure force of 8 MPa, in variant B the release torque which was higher than that of variant A by at least 15% was measured.

Other features which are considered as characteristic for the invention are set forth in the appended claims.

Although the invention is illustrated and described herein as embodied in an electrode connection with coated contact surfaces, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
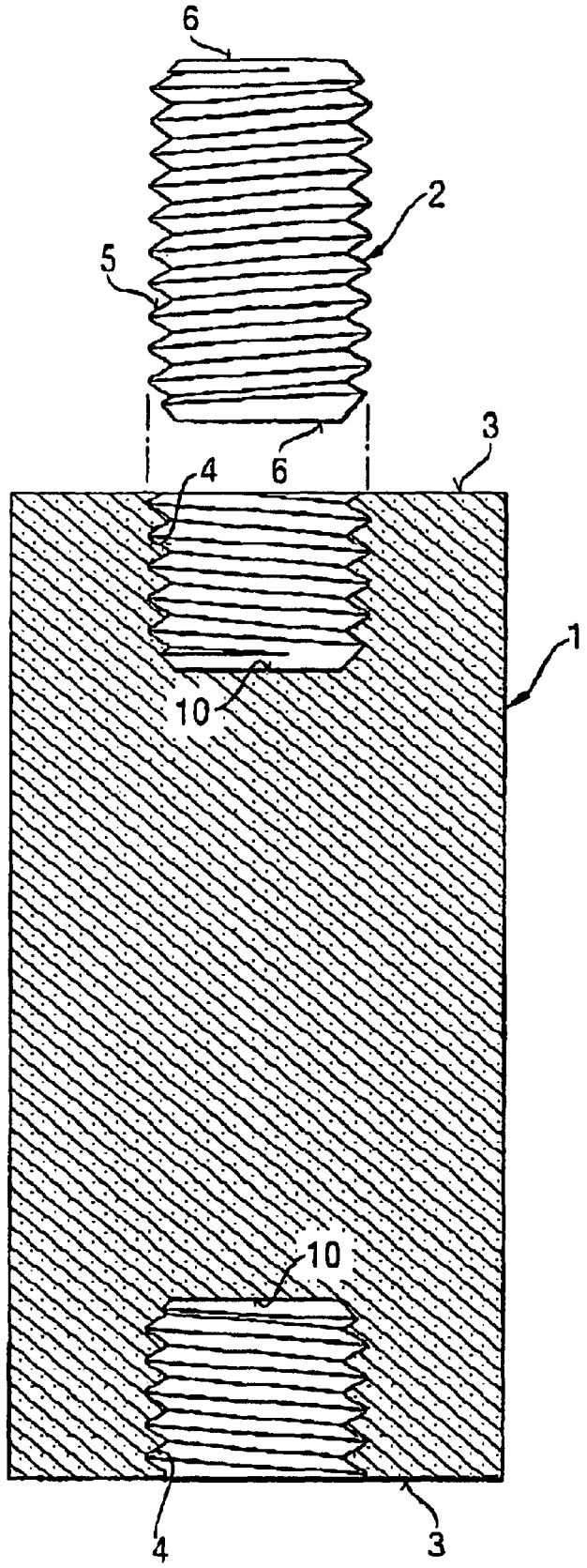
FIG. 1 is a diagrammatic, axially-parallel, longitudinal-sectional view of an electrode with boxes introduced into end surfaces on both sides, in each case with a cylindrical internal thread, as well as a longitudinal, side-elevational view of an independent nipple with a cylindrical thread.

Referring now to the figures of the drawings in detail and first, particularly, to FIG. 1 thereof, there is seen an electrode or electrode element 1, in which the following are identified as contact surfaces of the electrode 1:

an end surface 3 of the electrode 1, and threaded surfaces 4 of a coaxially disposed electrode box.

The electrode 1 has a box bottom 10 which is not a contact surface to be provided with a sliding layer.

In the case of an independent nipple or nipple element 2, the following are provided:

contact surfaces, which are threaded surfaces 5 of the nipple 2, and end surfaces 6 of the nipple 2 which are located on both sides.

Figure 2:
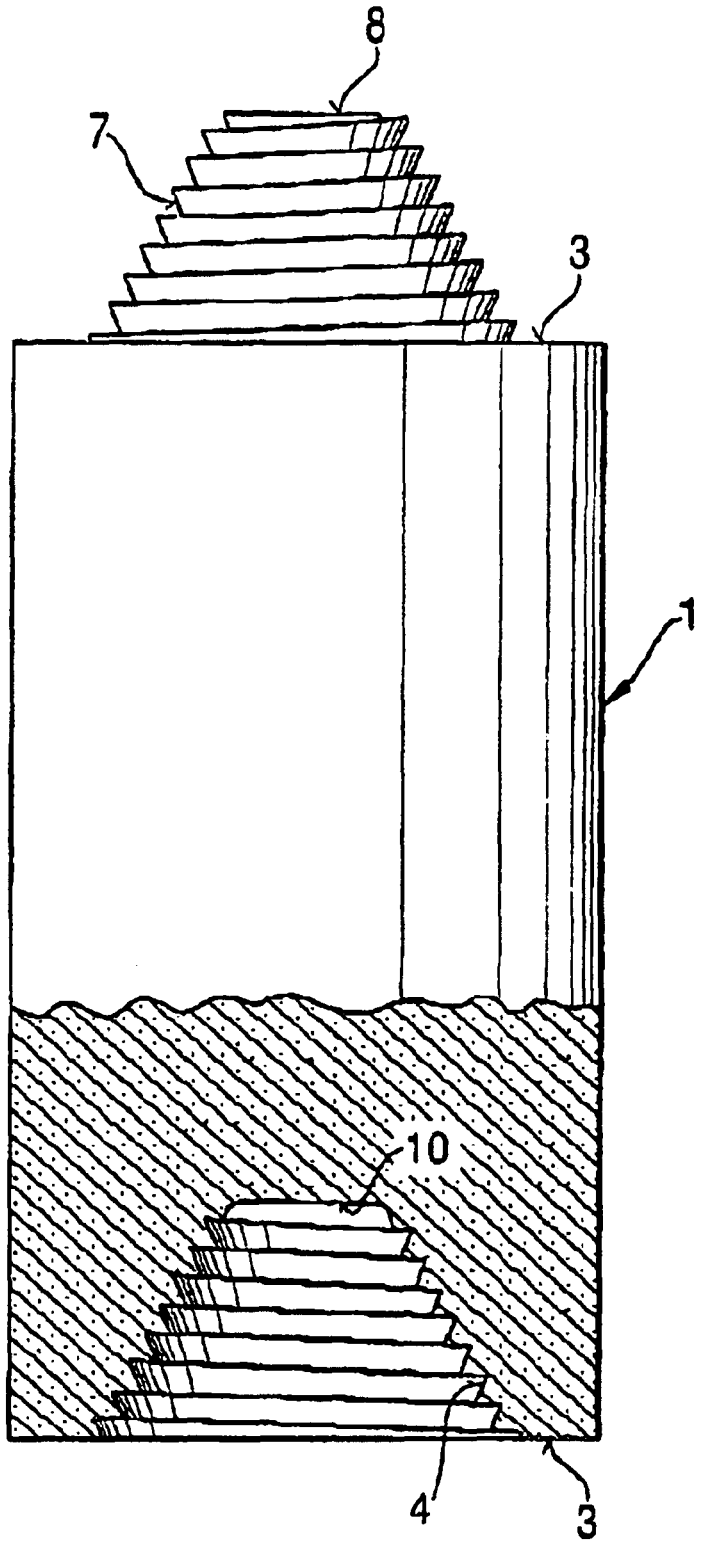
FIG. 2 is a longitudinal, side-elevational view of an electrode with an integrated coaxial nipple integrally formed on one end side in one portion, as well as a partly broken-away, axially-parallel, longitudinal-sectional view of the electrode showing a box with a conical internal thread at that location, in another portion.

According to FIG. 2, the following are identified as contact surfaces of electrodes 1 having an integrated nipple:

an end surface 3 of the electrode 1, threaded surfaces 7 of the integrated coaxial nipple, and an end surface 3 and threaded surfaces 4 of a box on the other end side of the electrode 1.

An outer end surface 8 of the integrated coaxial nipple is not a contact surface to be provided with a sliding layer.

A box bottom 10 of the electrode is not a contact surface to be provided with a sliding layer.

Figure 3:
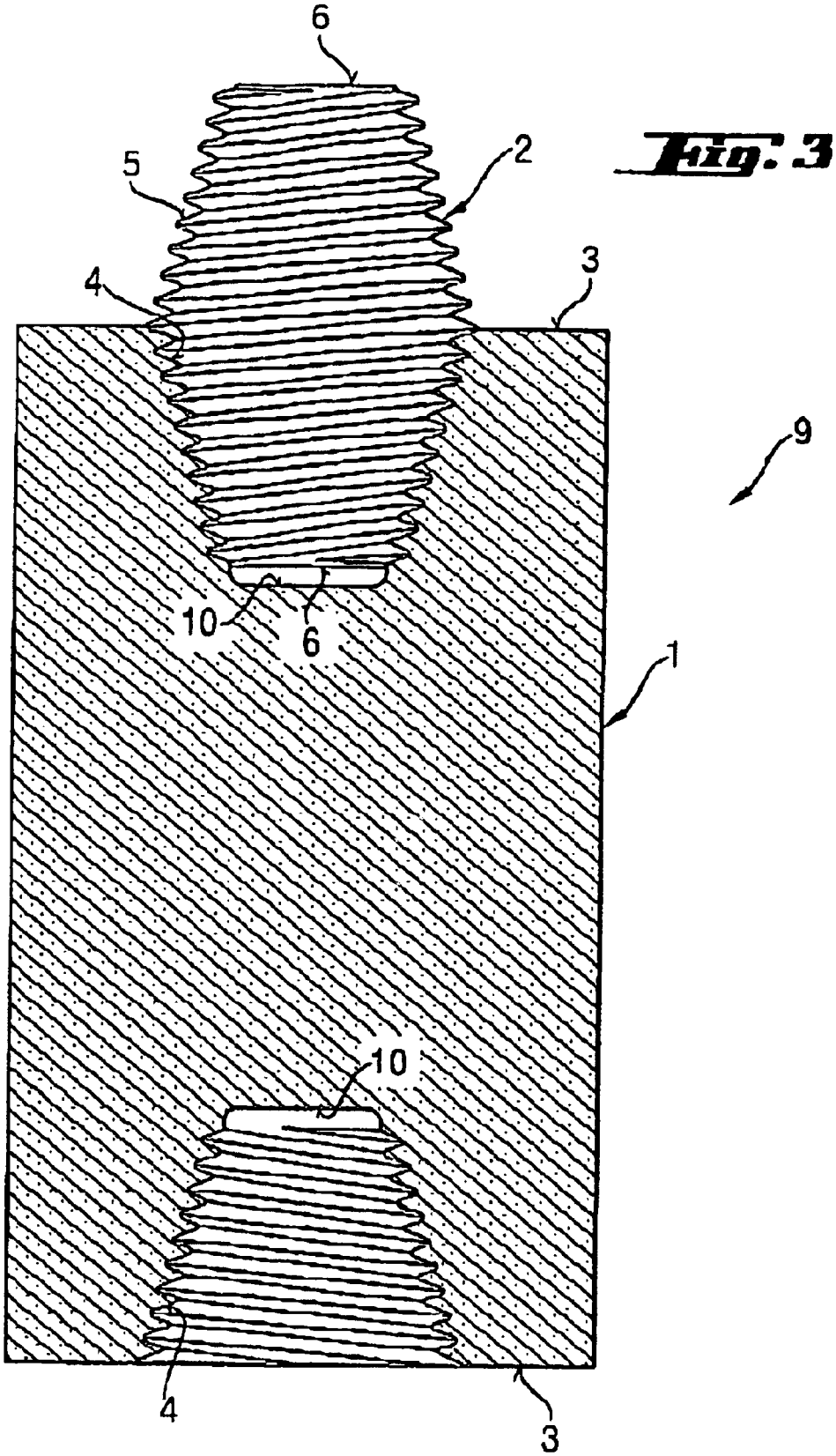
FIG. 3 is an axially-parallel, longitudinal-sectional view of a preset formed of an electrode with conical boxes and of a nipple with a double-conical thread.

According to FIG. 3, the following are identified as inner contact surfaces of a preset 9:

threaded surfaces 4 of a coaxially disposed electrode box, and threaded surfaces 5 of an independent nipple 2.

End surfaces 6 of the nipple 2 are not contact surfaces to be provided with a sliding layer.

The following are identified as outer contact surfaces of the preset 9 on the side of the screwed-in nipple 2:

threaded surfaces 5 of the independent nipple 2, and an end surface 3 of the electrode 1.

The end surfaces 6 of the nipple 2 are not contact surfaces to be provided with a sliding layer.

The following are identified as outer contact surfaces of the preset 9 on the side without a screwed-in nipple:

an end surface 3 of the electrode 1, and threaded surfaces 4 of the coaxially disposed electrode box.

The box bottom 10 of the electrode is not a contact surface to be provided with a sliding layer.

We claim:

1. In an electrode string for use in an electric arc furnace for the production of high-melting metals, an electrode connection comprising:

electrode elements each having at least one end-side box with internal threads;

at least one nipple element with external threads to be screwed into said internal threads for interconnecting two of said electrode elements;

each of said elements having at least one contact surface to be placed in contact with at least one adjacent contact surface of another of said elements; and a thin sliding layer applied on said contact surfaces;

said adjacent contact surfaces having a pressure force in a range of 0.1 to 80 N/mm$^2$.

2. The electrode connection according to claim 1, wherein at least one of said electrode elements has two of said end-side boxes with internal threads.

3. The electrode connection according to claim 1, wherein at least one of said electrode elements has one end-side box with internal threads and an integrated nipple element with external threads.

4. The electrode connection according to claim 1, wherein at least one of said electrode elements and a nipple element jointly form a preset.

5. The electrode connection according to claim 1, wherein said sliding layer contains at least one material lying on said contact surfaces partially or in a continuously closed manner and selected from the group of materials consisting of lubricants, solid lubricants, sliding lacquers, and additives, individually or in mixtures of two or more components, having kinematic viscosities of at least 20 mm$^2$/s.

6. The electrode connection according to claim 1, wherein said sliding layer on said adjacent contact surfaces contains a material selected from the group consisting of fluoropolymers, polytetrafluoroethylenes (PTFE) and solid lubricants, and said adjacent contact surfaces have a pressure force in a range of 0.1 to 5.0 N/mm$^2$.

7. The electrode connection according to claim 6, wherein said solid lubricants are at least one of molybdenum disulfides and silicones.

8. The electrode connection according to claim 1, wherein said sliding layer on said adjacent contact surfaces contains a material selected from the group of viscous lubricants with kinematic viscosities of between 20 and 1000 mm$^2$/s, and said adjacent contact surfaces have a pressure force in a range of 1 to 80 N/mm$^2$.

9. The electrode connection according to claim 8, wherein said kinematic viscosities are between 100 and 600 mm$^2$/s.

10. The electrode connection according to claim 8, wherein said viscous lubricants are at least one of paraffins and esterified long-chain carboxylic acids.

11. The electrode connection according to claim 1, wherein said contact surfaces are at least one of end surfaces of said electrode elements, threaded surfaces of said internal threads of said electrode box and threaded surfaces of said external threads of said at least one nipple element.

12. The electrode connection according to claim 1, wherein said sliding layer on said contact surfaces has a thickness of 0.001 mm to 5.00 mm in a delivery state of said electrode elements.

13. The electrode connection according to claim 12, wherein said sliding layer on said contact surfaces has a thickness of 0.005 mm to 0.50 mm, in a delivery state of said electrode elements.

14. The electrode connection according to claim 1, wherein said electrode elements and said at least one nipple element are formed of a material selected from the group consisting of carbonized carbon and graphite.

15. The electrode connection according to claim 1, wherein said electrode elements are formed of carbonized carbon and said at least one nipple element is formed of graphite.

* * * * *